United States Patent [19]

Konsti et al.

[11] 4,425,109

[45] Jan. 10, 1984

[54] METHOD OF PILING AND A TRANSPORT STORAGE PILE FORMED OF RIBBON

[75] Inventors: Pentti J. Konsti; Antti L. Nurmi, both of Nokia, Finland

[73] Assignee: OY Nokia AB, Helsinki, Finland

[21] Appl. No.: 326,179

[22] Filed: Dec. 1, 1981

[30] Foreign Application Priority Data

Dec. 9, 1980 [FI] Finland ..... 803819

[51] Int. Cl.[3] ..... B65H 45/20

[52] U.S. Cl. ..... 493/410; 19/302; 28/291; 156/204; 156/439; 226/118; 270/39; 493/413

[58] Field of Search ..... 493/409–415, 493/430, 433; 270/39; 19/160, 163; 28/291; 226/118–119; 428/105; 156/110 R, 123 R, 133, 204, 269, 270, 302, 324, 438–439, 474, 443, 478, 482

[56] References Cited

U.S. PATENT DOCUMENTS 3,644,165 2/1972 Chen ..... 156/439 X 3,673,757 7/1972 Willis ..... 53/117 X 3,756,893 9/1973 Smith ..... 156/439 X

*Primary Examiner*—A. J. Heinz

*Attorney, Agent, or Firm*—Finnegan, Henderson, Farabow, Garrett & Dunner

[57] ABSTRACT

A method of piling plastics or rubber mixture ribbons on a support (1) for transport and storage wherein the ribbon (2) is folded in superimposed layers (3,4). The ribbon is folded in each layer partly to overlap not more than $\frac{2}{3}$ of the width of the ribbon in each fold. The folding direction (B) is in at least some of the layers (4) changed preferably 90° with respect to the folding direction (A) of the other layers. In this way the ribbon can be folded in layers crosswise and the pile formed will be firmly bound so that the pile remains intact without any supporting borders.

The transport and storage pile comprises a pallet on which are folded superimposed ribbon layers in crosswise layers. In each layer the ribbon is folded overlapping so as to bind the pile into a firm and durable unit (FIG. 1).

8 Claims, 2 Drawing Figures

METHOD OF PILING AND A TRANSPORT STORAGE PILE FORMED OF RIBBON

Figure 1:
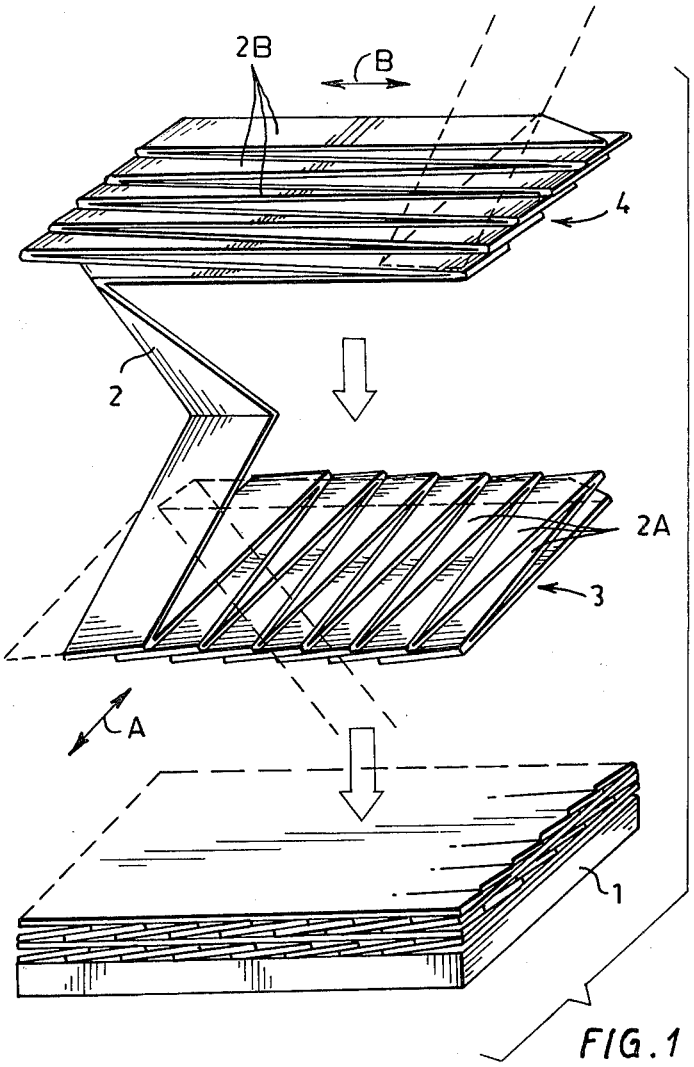

The present invention relates to method of piling rubber or plastics mixture ribbons on a support for transport and storage according to which method said ribbon is folded in superimposed layers.

When storing plastic sheets, such as elastomers and rubber mixtures for use in the plastics and rubber industry, bundles and different types of piles either in boxes provided with borders or on pallets have been used. The sheets have also been stored by automatically folding the sheets on a pallet either as a ribbon having the width of a standard pallet or partly cut into narrower ribbons in which case the uncut parts between the ribbons hold the pile together. Recently, the sheets have also been cut into narrower ribbons having a minimum width of 50 mm while the thickness of the sheet is 5 to 15 mm. In practice, the ribbons have been folded into boxes either manually or by means of folding devices folding in one direction which has resulted in a ribbon pile or a more or less indefinite shape. Especially when operating on a large scale rubber mixtures have been formed into tablets and stored in silos or in boxes.

When aiming at a more uniform quality in production steps have been taken to intermix batches in individual process steps, i.e. to homogenize them. In such a case storage in tablet form offers the best possibilities for mixing. However, the method has not gained any wider approval due to expensive investments. Storage using ribbons either partly cut off from a sheet or stored in boxes as described above is being used more and more widely. In practice, the use of a partly cut off ribbon succeeds only if the mixture sheet having a width of 70 to 100 mm is cut into either two or three ribbons. In the case of narrower ribbons, unfolding causes difficulties. A pile folded at random in a box is, moreover, entangled and requires continuous supervision during unfolding.

As far as the utilization of space is concerned, sheet storage is the most efficient system. Ribbon storage of a ribbon folded at random requires twice as much space. Also tablet stores require fixed storage spaces and are in this respect comparable to loose ribbon storage.

The object of the present invention is to provide a transport and storage method which eliminates the above-mentioned disadvantages. This object is achieved by means of the method according to the invention which is characterized in that said ribbon is in each layer folded partly overlapping, and in that at least in some of the layers the folding direction is changed to form an angle with respect to the folding direction of the other layers.

The invention is based on the idea of folding the ribbon in layers crosswise on a storage pallet and of arranging the ribbon folds overlapping in each layer. The folding direction is preferably changed after each full layer and, when the pallet is rectangular, the change of the folding direction is 90°. The overlapping folds are formed by causing each fold to overlap at least $\frac{1}{3}$ and maximum $\frac{2}{3}$ of the ribbon width.

Such a storage method considerably improves the possibilities of automatizing and homogenizing the mixing machine the hose machine and the heating roller feed device. As regards the utilization of space, the method is comparable to piles folded of a wide ribbon on storage pallets and is nearly twice as efficient than box storage. Also as far as transportation is concerned, considerable savings in packing costs can be achieved because standard transport pallets without borders can be used.

The invention also relates to a transport and storage pile of a plastics rubber mixture ribbon which is characterized in that said ribbon is in each layer folded partly overlapping, and in that the folding direction of at least some of the layers forms an angle with the folding direction of the other layers.

A pile according to the invention is unloaded systematically from the beginning to the end and remains upright during transport and storage without any supporting borders. Because of this, boxes provided with borders and requiring much space are avoided.

Figure 2:
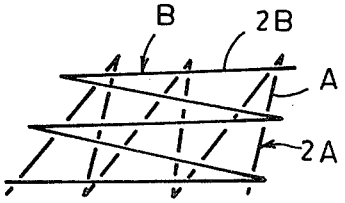

In the following, the invention will be described in more detail with reference to the accompanying drawing in which FIG. 1 illustrates a ribbon pile folded by means of the method according to the invention, the layers being partly spaced apart for the sake of clarity, and FIG. 2 illustrates schematically the folding principle according to the invention.

The ribbon pile shown in the drawing comprises a pallet 1 which serves as a transport and storage base and on which is folded in layers a ribbon 2 which has been pretreated with insulating material in order to prevent adhesion. Two successive ribbon layers are indicated by the reference numerals 3 and 4. Each layer comprises a plurality of folds 2A and 2B, respectively, which overlap each other about $\frac{1}{3}$ of the width of the ribbon in each fold. At the edge of the pallet, the folding direction A of the layer has been changed to form an angle of 90° with the folding direction B in the layer 4. Such a change of direction can take place after each layer, as shown in FIG. 1, or several layers can be folded in the same direction before the direction is changed. The object of the change of direction is to firmly bind the pile formed. The most advantageous result is achieved if the thickness of the ribbon is not more than 10% of the width. So many layers are formed in the pile that the pile still is held together and does not slide down during storage. In this way, it is not necessary to provide the pallet with space-requiring borders.

The drawings and the description related thereto are only intended to illustrate the idea of the invention. In its details the method according to the invention and the pile prepared in accordance therewith may vary within the scope of the claims.

What we claim are:

1. A method of piling a continuous rubber or plastics mixture material ribbon on a support having a predetermined length and width for transporting and storage comprising the steps of forming a first layer of material produced by folding said ribbon back and forth along substantially the entire length of said support to form a plurality of adjacent folds with the fold lines where the ribbon is bent back over upon its self running substantially parallel to the width dimension of the support, causing each successive fold to overlap a preceding adjacent fold by at least $\frac{1}{3}$ of the ribbon width throughout the length of each fold across substantially the entire width of said support, forming a second layer of material on said first layer of material by folding said ribbon back and forth across substantially the entire width of said support to form a plurality of adjacent folds with the fold lines of the ribbon in the second layer running substantially parallel to the length dimension of the support, and causing each successive fold to overlap a preceding fold in said second layer by at least $\frac{1}{3}$ of the ribbon width throughout the length of each fold across substantially the entire length of said support.

2. A method according to claim 1, wherein said ribbon folds overlap adjacent folds no more than $\frac{2}{3}$ of the ribbon width throughout the length of each fold.

3. A method according to claim 1 or 2, including the steps of forming a plurality of successive layers of folds on said first and second layers of folds, each successive layer of folds being formed, alternately, by folding said ribbon back and forth along substantially the entire length of said support and back and forth along substantially the entire width of said support.

4. A method according to claim 3, wherein the folding direction of said ribbon in each layer is arranged at substantially 90° with respect to the folding direction in adjacent layers.

5. A transport and storage pile formed by folding a continuous rubber or plastics mixture ribbon material comprising a support having a predetermined length and width, a plurality of superimposed folded ribbon layers of said material on said support, a first one of said layers of material being formed by folding said ribbon back and forth along substantially the entire length of said support to form a plurality of adjacent folds with the fold lines where the ribbon is bent back over upon itself running substantially parallel to the width dimension of the support, each successive fold overlapping a preceding adjacent fold by at least $\frac{1}{3}$ of the ribbon width throughout the length of each fold across substantially the entire width of said support, a second one of said layers being formed by folding said ribbon back and forth across substantially the entire width of said support to form a plurality of adjacent folds with the fold lines of the ribbon in the second layer running substantially parallel to the length dimension of the support, each successive fold overlapping a preceding fold in said second layer by at least $\frac{1}{3}$ of the ribbon width throughout the length of each fold across substantially the entire length of said support.

6. A transport and storage pile according to claim 5, said ribbon folds in each of said layers overlapping adjacent folds by no more than $\frac{2}{3}$ of the width of the ribbon throughout the length of each fold.

7. A transport and storage pile according to claim 5, including a plurality of additional superimposed folded ribbon layers on said first and second layers, each successive layer being formed by alternately folding said ribbon back and forth along substantially the entire length of said support and back and forth along substantially the entire width of said support.

8. A transport and storage pile according to claim 7, wherein the folding direction of ribbon in each layer forms an angle of substantially 90° with the folding direction of ribbon in each adjacent layer.

* * * * *